US007232339B1

(12) United States Patent
Wilson et al.

(10) Patent No.: US 7,232,339 B1
(45) Date of Patent: Jun. 19, 2007

(54) SEALED ELECTRICAL CONNECTOR

(75) Inventors: Bill Blake Wilson, Montgomery, IL (US); Mathew W. Sandberg, North Aurora, IL (US); Gary E. Polgar, Bolingbrook, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/437,446

(22) Filed: May 19, 2006

(51) Int. Cl.
*H01R 13/40* (2006.01)

(52) U.S. Cl. ..... 439/595; 439/744; 439/752

(58) Field of Classification Search ..... 439/586, 439/595, 744, 752
See application file for complete search history.

(56) References Cited

U.S. PATENT DOCUMENTS 4,955,827 A 9/1990 Roy et al.
6,159,047 A * 12/2000 Tanaka ..... 439/595
6,375,501 B1 4/2002 Kojima
6,676,448 B2 * 1/2004 Kato et al. ..... 439/595
6,752,660 B2 * 6/2004 Fujita et al. ..... 439/595
6,767,226 B2 7/2004 Varatta

* cited by examiner

*Primary Examiner*—Michael C. Zarroli
(74) *Attorney, Agent, or Firm*—Romi N. Bose

(57) ABSTRACT

An electrical connector includes a dielectric housing having at least one terminal-receiving passage extending in a terminal-insertion direction. A pair of grooves are respectively formed in side walls of the passage and extend in the terminal-insertion direction. A conductive terminal having side walls is inserted into the passage. A pair of smooth outwardly extending projections is formed on the side walls for riding in the grooves in the side walls of the passage. A locking shoulder is spaced from the projections a distance greater than the given distance, whereby the front contact end of the terminal can be inserted into the passage only when the top walls of the terminal and the passage are juxtaposed to align the projections on the terminal with the grooves in the passage.

10 Claims, 5 Drawing Sheets

FIG. 1
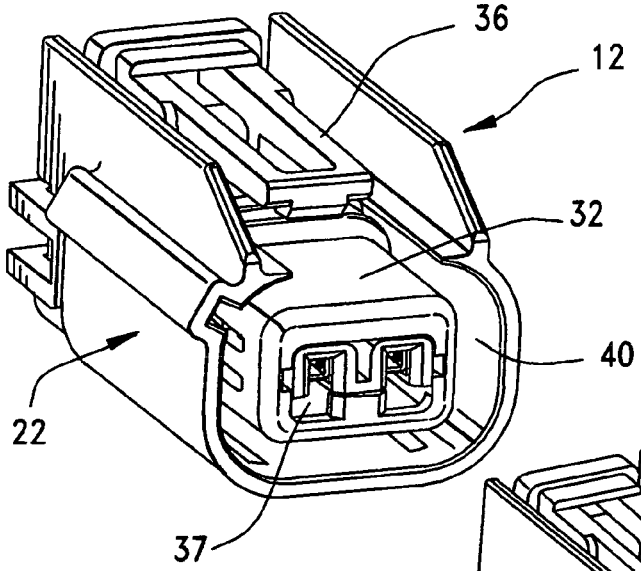
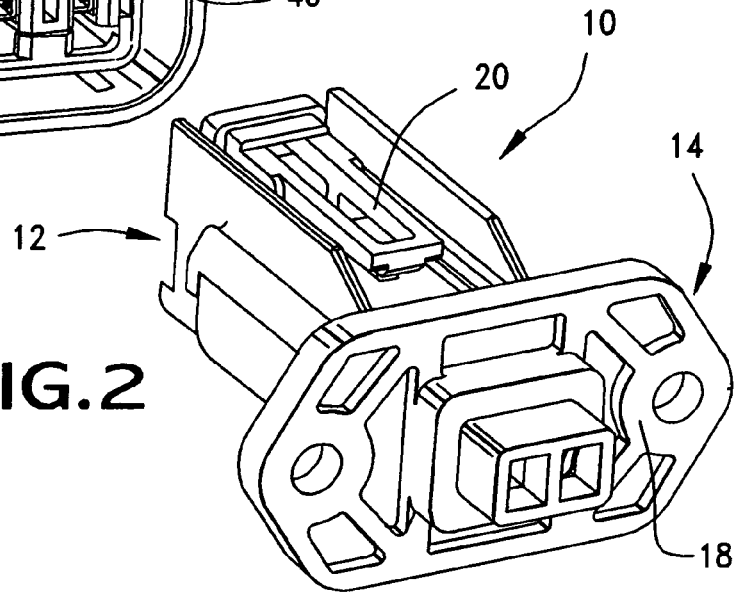
FIG. 2
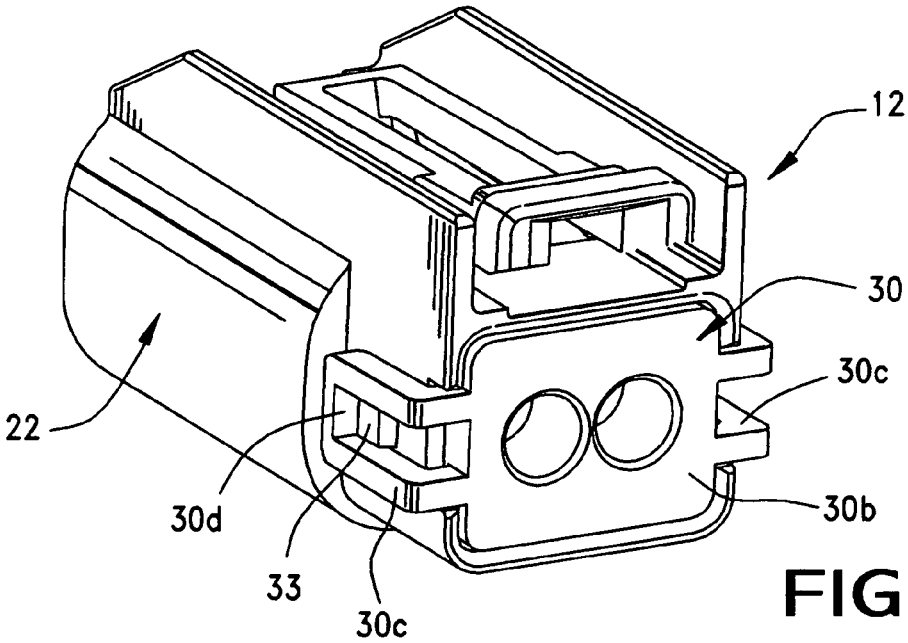
FIG. 3

FIG.7
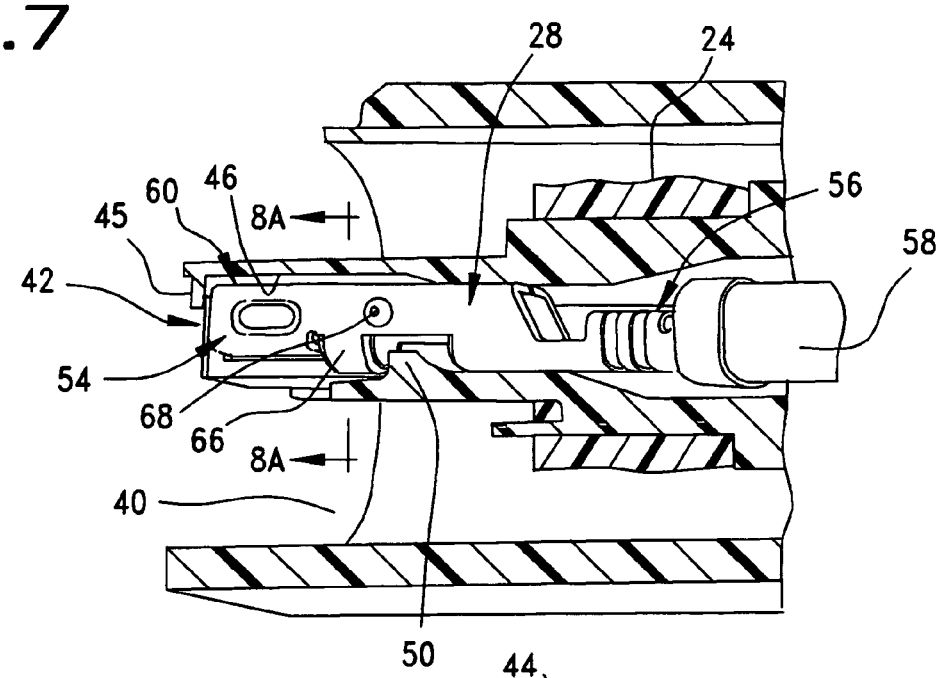
FIG.8A
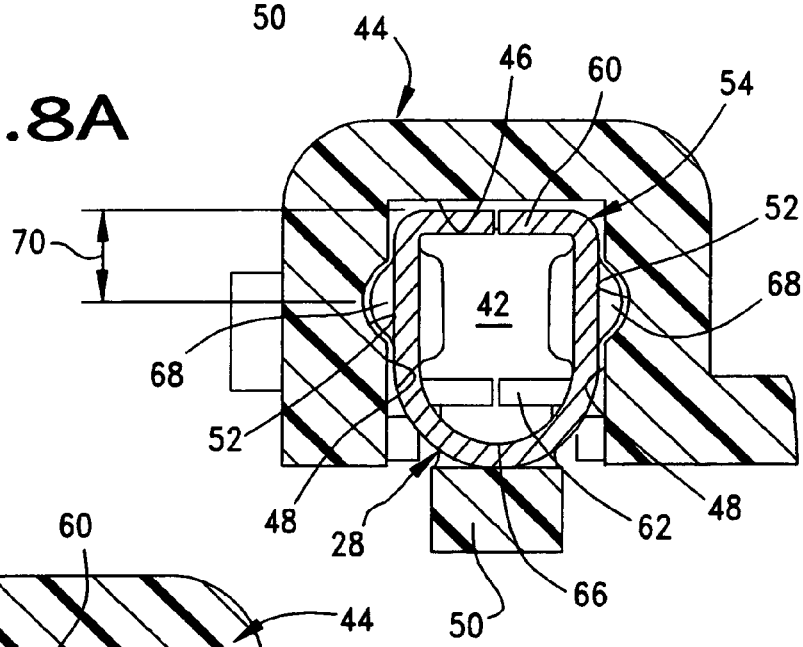
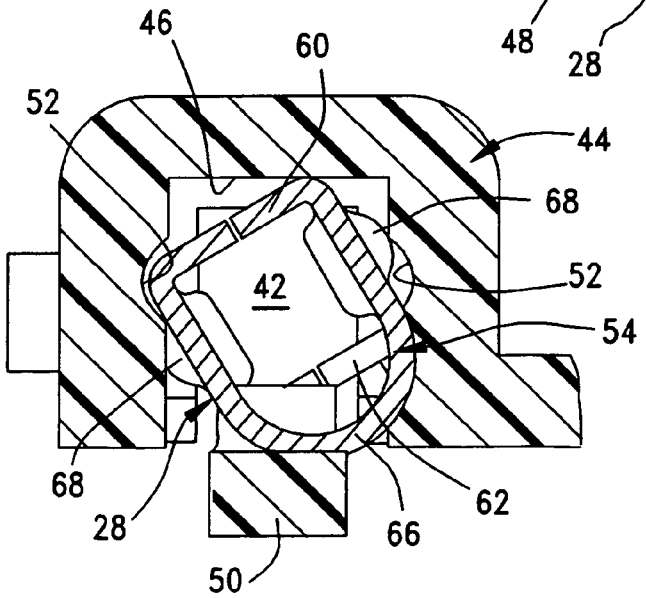
FIG.8B

FIG.8C
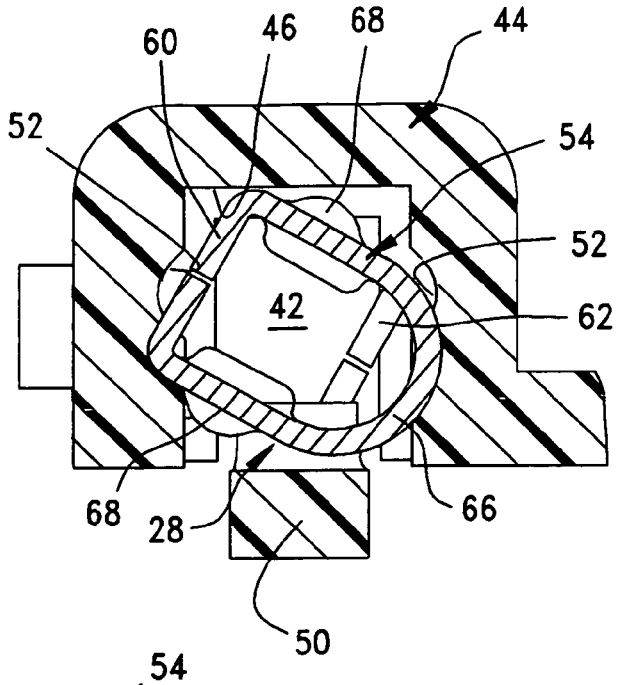
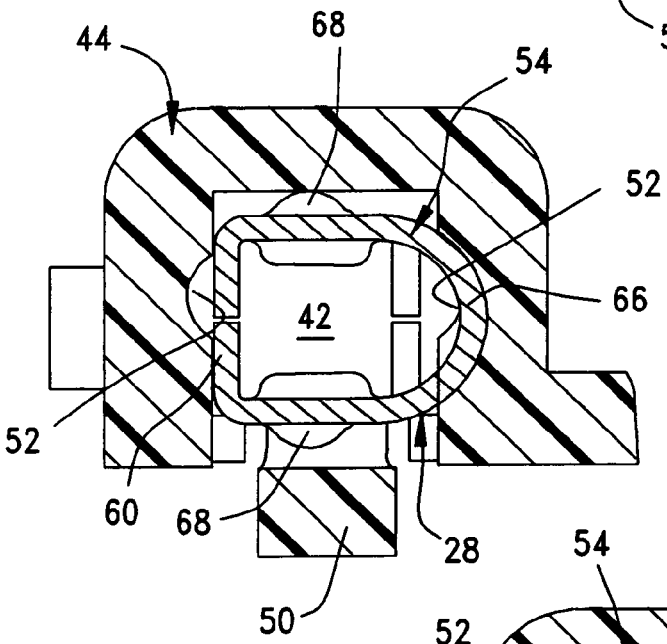
FIG.8D
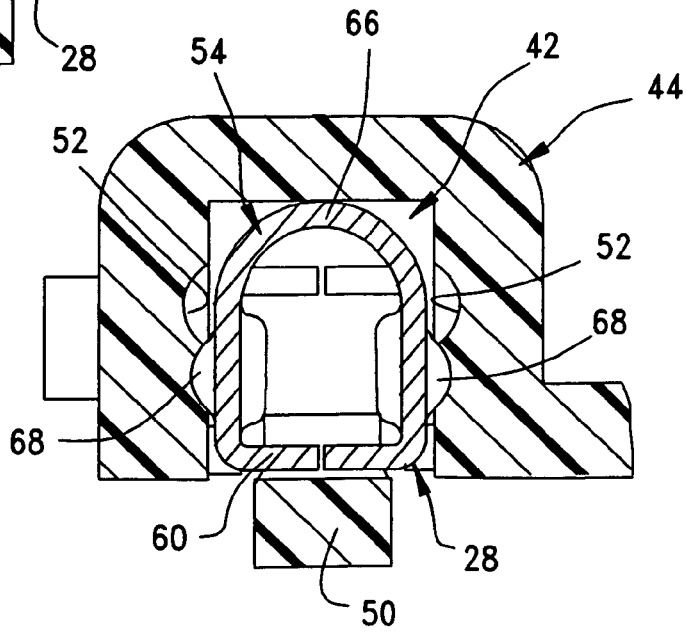
FIG.8E

SEALED ELECTRICAL CONNECTOR

FIELD OF THE INVENTION

This invention generally relates to the art of electrical connectors and, particularly, to an electrical connector wherein a conductive terminal can be inserted into a connector housing in only one orientation.

BACKGROUND OF THE INVENTION

An electrical connector typically includes some form of insulative or dielectric housing which mounts one or more conductive terminals. The housing typically has a plurality of terminal-receiving passages into which the terminals are inserted. For instance, the terminals may be inserted into the passages from a rear terminating end of the housing.

A majority of the terminals for electrical connectors as described above, typically are round, square or rectangular in cross-section and have a cantilevered arm which locks to a locking recess in the terminal insertion cavity in the housing. These terminals must be inserted into the terminal-receiving passages in the connector housing in only one angular orientation to prevent damage to portions of the terminals, to portions of the housing or to the terminals or housing of a complementary mating connector. Also the terminals must have a shape and configuration to easily pass through a rear seal without damaging it. Because the rear seal covers the terminal insertion passage, the insertion of a terminal into the passage is blind making the insertion into the passage in the proper orientation even more difficult. The present invention is directed to solving these problems.

SUMMARY OF THE INVENTION

An object, therefore, of the invention is to provide a new and improved electrical connector of the character described.

In the exemplary embodiment of the invention, an electrical connector includes a non-conductive housing having at least one elongated terminal-receiving passage extending in a terminal-insertion direction. The passage includes a top wall and a pair of opposite side walls with a locking finger at the bottom of the passage. A pair of grooves are respectively formed in the side walls and extend in the terminal-insertion direction. The grooves are spaced a given distance from the top wall of the passage. A conductive terminal is insertable into the passage and includes a front contact end and a rear terminating end. The front contact end has a cross section corresponding to that of the passage, as defined by a top wall and a pair of opposite side walls with a locking shoulder at the bottom of the contact end. A pair of outwardly extending projections are formed on the side walls for riding in the grooves in the side walls of the passage. The projections are spaced a distance from the top wall of the terminal the same given distance that the grooves are spaced from the top wall of the passage. The locking shoulder is spaced from the projections a distance greater than the given distance, whereby the front contact end, projections, and locking shoulder of the terminal can be inserted into the passage only when the top walls of the terminal and the passage are juxtaposed to align the projections on the terminal with the grooves in the passage. This arrangement will help to properly orient the terminal in the housing.

According to one aspect of the invention, the front contact end of the terminal has a generally smooth outside surface. An elastomeric seal is provided at a rear of the connector housing. The seal has a hole aligned with the terminal-receiving passage and through which the smooth front end, the projections, and the locking shoulder of the terminal is inserted.

As disclosed herein, the front contact end of the terminal is generally square in cross-section and includes a bottom wall. The locking shoulder projects outwardly beyond the bottom wall. In the exemplary embodiment, the locking shoulder is generally U-shaped. The outwardly extending projections comprise rounded bosses. This configuration will help to prevent damage to a rear seal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of the electrical connector of the invention;

FIG. 2 is a perspective view of an electrical connector assembly including the electrical connector of the invention, mated with another connector;

FIG. 3 is a perspective view looking at the terminating end of the connector of the invention;

FIG. 7 is an enlarged, fragmented section of the left-hand end of FIG. 5 and at a different angle relative thereto;

FIG. 8A is an enlarged vertical section taken generally along line 7A—7A in FIG. 6; and FIGS. 8B–8E are views similar to that of FIG. 7A, but showing different angular orientations of the terminal and in which the terminal is prevented from being inserted into the passage.

DETAILED DESCRIPTION OF THE PREFERRED EMBODIMENT

Figure 4:
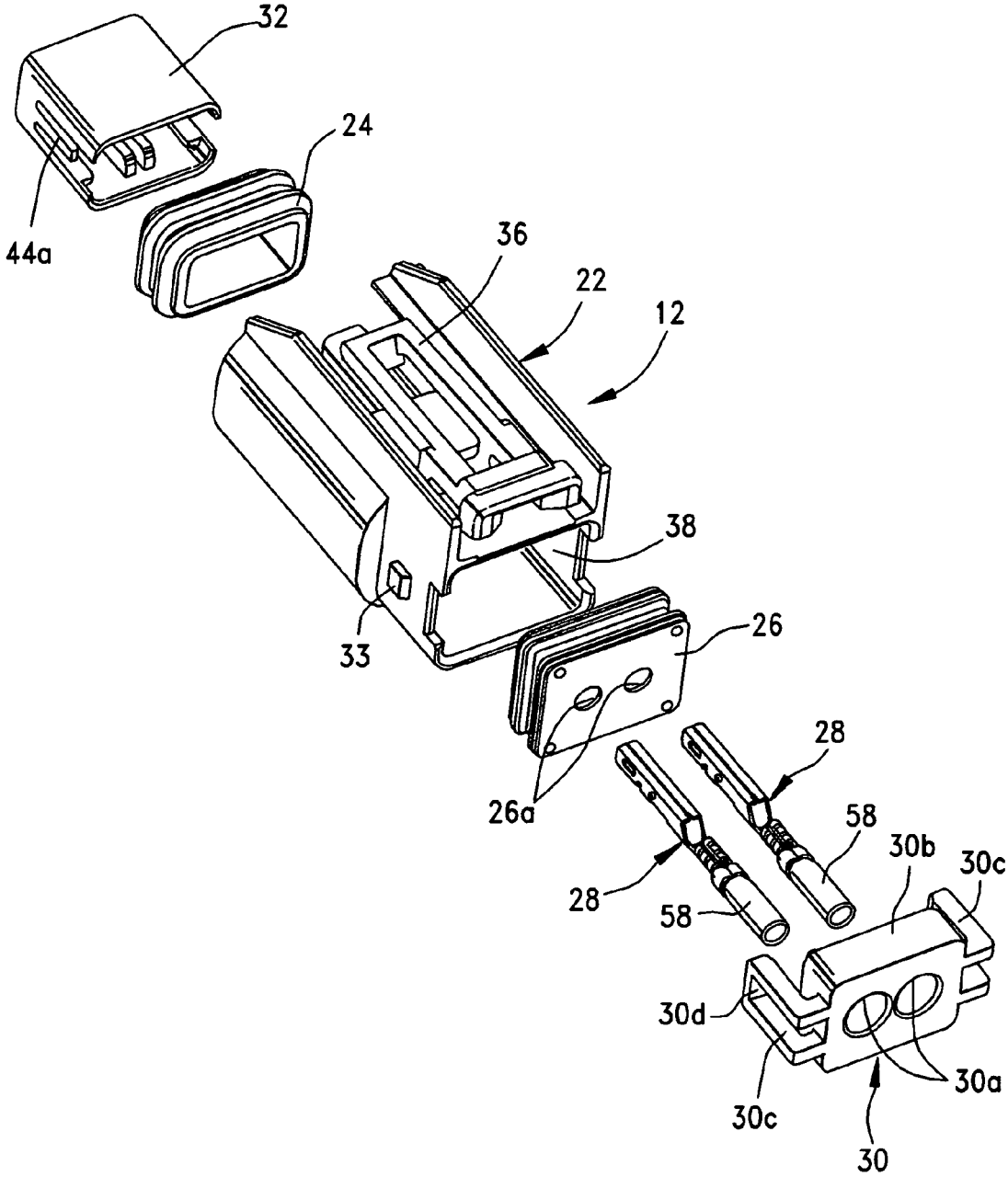
FIG. 4 is an exploded perspective view of the connector of FIG. 2.

Referring to the drawings in greater detail, and first to FIG. 1, an electrical connector assembly, generally designated 10, includes a receptacle connector, generally designated 12, for mating with a plug connector, generally designated 14. The plug connector includes a front plug portion (not shown), a rear bracket portion 18 and a latch 20. The invention herein is incorporated in receptacle connector 12.

More particularly, referring to FIGS. 3 and 4 in conjunction with FIG. 1, receptacle connector 12 includes an insulative or non-conductive housing, generally designated 22, along with a front elastomeric seal 24 and a rear elastomeric seal 26 which seal the interior of the housing from the environment. The rear seal has a pair of through passages 26*a* through which a pair of conductive terminals, generally designated 28, are inserted into the housing. A rear bracket, generally designated 30, holds the rear seal 26 in the housing, and the bracket has a pair of through holes 30*a* which are aligned with holes 26*a* in the rear seal and through which the terminals are inserted. In some applications the rear bracket may not be used. A front shroud 32 is in place to engage the front seal 24 if the front seal moves when the mating connectors are disengaged from each other.

Rear bracket 30 includes a pressure block 30*b* through which holes 30*a* extend. The bracket may be molded of plastic material and includes a pair of flexible latch arms 30*c* which define latch shoulders 30*d*. FIG. 2 shows rear bracket 30 mounted to housing 22 and latched to the housing by latch shoulders 30*d* of latch arms 30*c* "snapping" into latching engagement with a pair of chamfered latch bosses 33 at opposite sides of the housing. When so latched, pressure block 30*b* of the rear bracket engages the elastomeric rear seal 26 and presses the rear seal against an interior shoulder 34 (FIG. 5) of the housing which causes the outer surface of the rear seal 26 which is already in an interference fit with the inner tapered wall 35 of the housing to be forced into a greater interference fit. Once the wire is inserted into the through passage 26*a*, the combination of the wire in the through passage and the rear seal in the opening will seal the rear of the housing.

Figure 5:
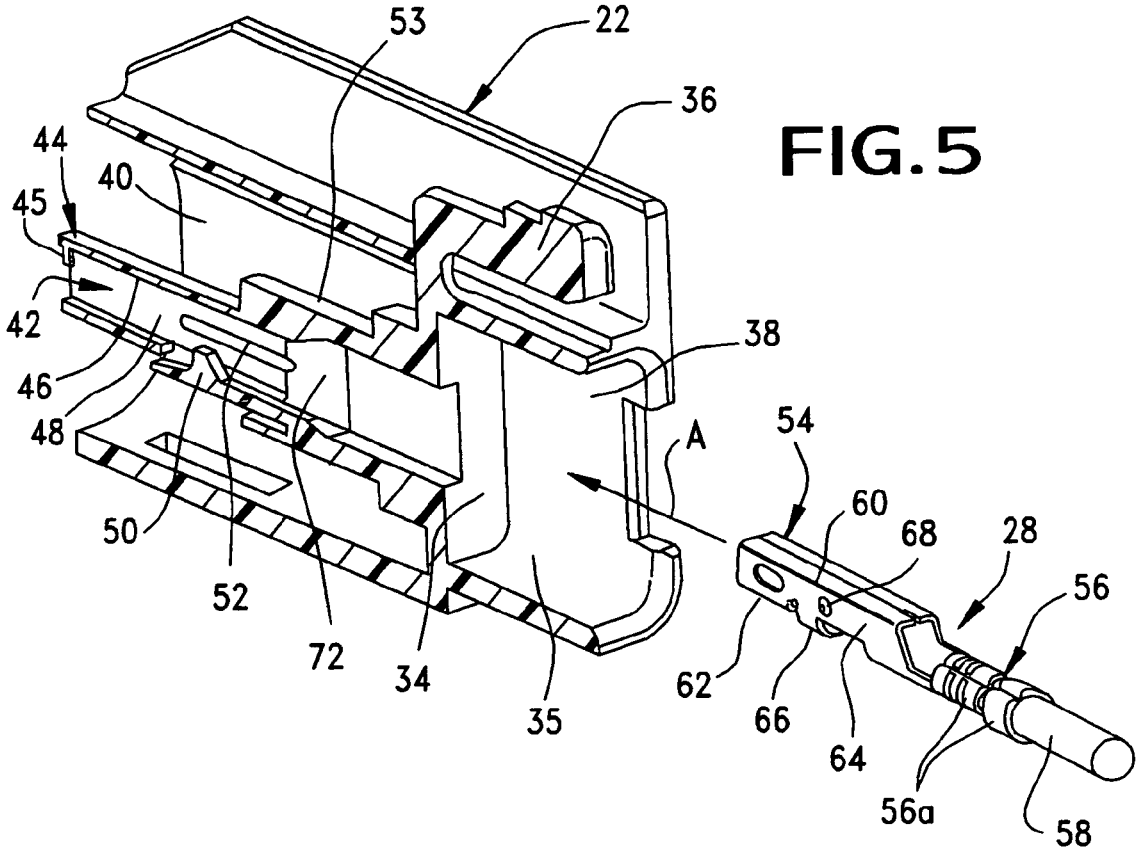
FIG. 5 is a vertical section through the connector housing, in combination with one of the terminals removed from the housing.
Figure 6:
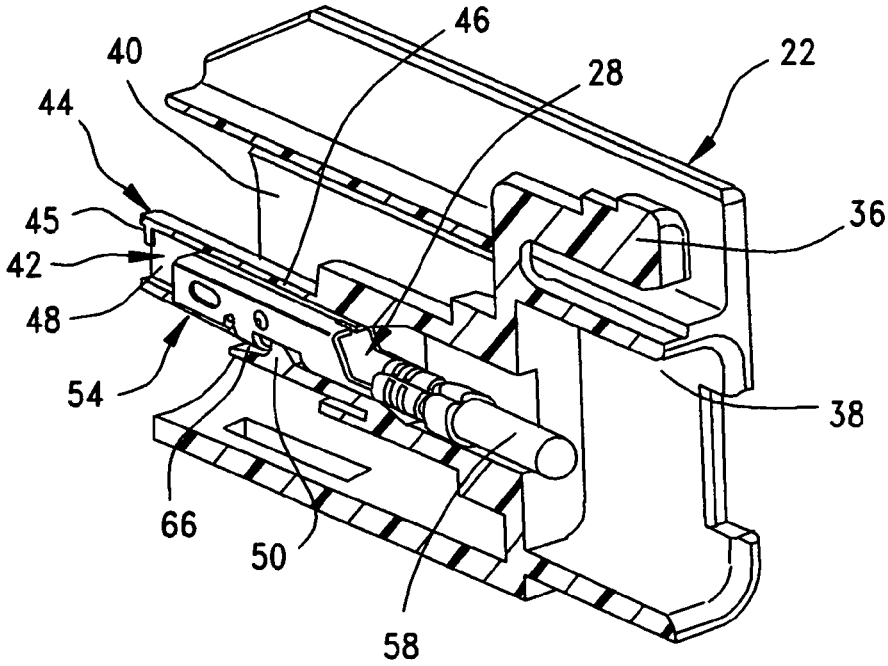
FIG. 6 is a view similar to that of FIG. 4, with the terminal inserted into the housing.

Referring to FIG. 5 in conjunction with FIGS. 1 and 3, housing 22 of receptacle connector 12 is a one-piece structure unitarily molded of dielectric material such as plastic or the like. The housing has a flexible top latch 36 for latching engagement with latch boss 20 of plug connector 14 to hold the two connectors in mated condition. A cavity 38 is formed at the rear of the housing for receiving rear seal 26 and rear bracket 30 as described above and as shown in FIG. 3, with rear seal 26 pressed against interior shoulder 34 of the housing and forcing the outer seal wall which is already in an interference fit with the inner housing wall 35 into a greater interference fit. The housing has a front receptacle 40 for receiving plug portion 16 of plug connector 14.

Non-conductive housing 22 includes a pair of elongated terminal-receiving passages, generally designated 42 in FIG. 5. Actually, the passages are formed within a pair of silos, generally designated 44, which extend forwardly into front receptacle 40 and which are spaced inwardly from the interior walls of the receptacle. The passage 42 of the silos 44 end with a front wall stop 45 which only partially covers the front opening of the passage. The passages are generally square in cross-section and receive terminals 28 in a terminal-insertion direction indicated by arrow "A". Each passage includes a top wall 46 and a pair of opposite side walls 48. A locking finger 50 is formed at the bottom of the passage. A pair of rounded grooves 52 are formed in the opposite side walls 48, with the grooves extending in the terminal-insertion direction "A". As will be understood hereinafter, the grooves are spaced a given distance from top wall 46 of the respective passage.

Front shroud 32 can be press-fit over silos 44, or the shroud can have latch arms 44*a* (FIG. 4), for holding front seal 24 within front receptacle 40. The shroud keeps the front seal, which is placed against an interior wall 53 of the housing, from sliding out of engagement with the interior wall when the mating connectors are disengaged from one another. This front shroud also provides a lead-in alignment for the blades of the mating plug 18 and protects the plastic locking fingers 50 from damage. Furthermore, it provides an access opening directly in line with the plastic locking fingers for an operator to slide in a tool such as a screwdriver (not shown) to disengage the locking finger from the terminal. This would allow for the removal and replacement of the terminal if it was accidentally inserted into the wrong location. Finally, this front shroud protects the locking fingers from bending to an extreme over-stressed position.

The conductive terminals 28 are stamped and formed of conductive sheet metal material. Still referring to FIG. 5, each terminal includes a front contact end, generally designated 54, and a rear terminating end, generally designated 56. The rear end has a plurality of crimp arms 56*a* for crimping onto the conductor and the outer insulating cladding of an electrical wire 58. The front contact end 54 of each terminal has a generally square cross-section corresponding to that of its respective passage 42, as defined by a top wall 60, a bottom wall 62 and a pair of opposite side walls 64. A locking shoulder 66 projects downwardly of the contact end a distance beyond bottom wall 62. A pair of outwardly extending, rounded projections 68 project outwardly from side walls 64 for riding in the rounded grooves 52 in side walls 48 of the respective passage, as each terminal is inserted into the passage as seen in FIG. 5. Although passages 42 of the housing 22 and the contact ends 54 of terminals 28 are shown herein as being square in cross-section, the terminals and passages equally could be rectangular (i.e., non-square) within the concepts of the invention.

FIG. 7 shows one of the terminals 28 inserted into its respective terminal-receiving passage 42. It can be seen that locking shoulder 66 on the terminal has snapped into locking engagement with the locking finger 50 at the bottom of the passage when the terminal is properly inserted into its fully inserted position in the terminal-receiving passage 42. Top wall 60 of the terminal is juxtaposed immediately inside top wall 46 of the passage. This can be seen clearly in FIG. 8A. In this position the front of the terminal butts against the rear of the front wall stop 45 and the rounded projections 68 engage the front end of the grooves 52 which will prevent the terminal from moving out of the front portion of the housing.

Referring specifically to FIG. 8A, the contact end 54 of one of the terminals 28 is shown properly aligned and inserted into its respective passage 42. The grooves 52 in side walls 48 of passage 42 are spaced a given distance from top wall 46 of the passage, with this given distance indicated by double-headed arrow 70. Similarly, the outwardly extending projections 68 on the contact end of the terminal are spaced generally the same given distance 70 from top wall 60 of the terminal. Therefore, when the contact end of the terminal is properly oriented, angularly, with respect to the passage as shown in FIG. 8A and the rounded projections 68 are properly aligned with the grooves 52, the projections 68 ride smoothly in the rounded grooves 52 as the terminal is inserted into the passage. It also can be seen in FIG. 8A that locking shoulder 66 on the terminal is spaced from projections 68 a distance greater than the given distance 70.

FIGS. 8B–8E show various angular orientations of one of the terminals, generally designated 28, in relation to its respective terminal-receiving passage 42, and wherein the terminal is prevented from being inserted into the passage. As stated above, locking shoulder 66 extends a greater distance from top wall 60 of the terminal than the given distance 70 which the projections 68 extend from the top wall. Therefore, as seen in FIGS. 8B, 8C and 8D, the locking shoulder will abut against the housing in an area indicated at 72 in FIG. 5 and prevent the contact end of the terminal from being inserted into its passage.

Still further, FIG. 8E shows the terminal inverted 180° from its proper angular orientation shown in FIG. 8A. In the inverted orientation, locking shoulder 66 might be capable of moving into passage 42, but, in the inverted orientation, the outwardly extending projections 68 will abut against the housing (i.e., at 72 in FIG. 4) and prevent the terminal from being inserted into the passage in a wrong orientation.

Lastly, all of FIGS. 8A–8E show that the exterior surface of the contact end 54 of each terminal 28 is generally smooth (i.e., the corners are rounded) and the rounded projections 68 and the generally U-shaped locking shoulder 66 form a composite cross section having a smooth configuration. The smooth configuration and the smooth exterior surface of the contact end will allow for the terminal to be inserted through the through hole 26*a* in the rear seal 26 without damaging the rear seal 26. Thus the U-shaped locking shoulder 66 locks and orients the terminal in the housing while passing through the hole 26*a* in the rear seal without damaging the rear seal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising:

a non-conductive housing having at least one elongated terminal-receiving passage extending in a terminal-insertion direction (A), the passage including a top wall and a pair of opposite side walls with a locking finger at the bottom of the passage, and a pair of grooves respectively formed in the side walls and extending in said terminal-insertion direction, the grooves being spaced a given distance from the top wall of the passage;

a conductive terminal insertable into the passage and including a front contact end and a rear terminating end, the front contact end having a cross section corresponding to that of the passage as defined by a top wall and a pair of opposite side walls with a locking shoulder at the bottom of the contact end designed to be in locking engagement with the locking finger of the non-conductive housing when the terminal is properly inserted in the terminal-receiving passage, and a pair of outwardly extending projections on the side walls for riding in the grooves in the side walls of the passage, the projections being spaced said given distance from the top wall, and said locking shoulder being spaced from the projections a distance greater than said given distance whereby the front contact end of the terminal can be inserted into the passage only when the top wall of the terminal and the top wall of the passage are juxtaposed to align the projections on the terminal with the grooves in the passage; and an elastomeric seal at a rear of said housing, the seal having a through-hole aligned with said passage and through which the smooth front contact end of the terminal is inserted.

2. The electrical connector of claim 1 wherein the front contact end of said terminal is generally square in cross-section.

3. The electrical connector of claim 1 wherein the front contact end of said terminal has a generally smooth outside surface.

4. The electrical connector of claim 3 wherein the terminal forms a composite cross section including the outwardly extending projections and the locking shoulder both having smooth configurations.

5. The electrical connector of claim 4, wherein the outwardly extending projections and the locking shoulder of the terminal are inserted through the through-hole of the seal.

6. The electrical connector of claim 1 wherein the front contact end of said terminal is generally rectangular in cross-section and includes a bottom wall, said locking shoulder projecting outwardly beyond the bottom wall.

7. The electrical connector of claim 1 wherein said locking shoulder is generally U-shaped.

8. The electrical connector of claim 1 wherein said outwardly extending projections comprise rounded bosses.

9. An electrical connector, comprising:

a non-conductive housing having at least one elongated terminal-receiving passage extending in a terminal-insertion direction (A), the passage including a top wall and a pair of opposite side walls with a locking finger at the bottom of the passage, and a pair of rounded grooves respectively formed in the side walls and extending in said terminal-insertion direction, the grooves being spaced a given distance from the top wall of the passage;

an elastomeric seal at a rear of said housing, the seal having a through hole aligned with said passage;

a conductive terminal, the front contact end having a generally smooth outside surface and a cross section corresponding to that of the passage as defined by a top wall, a bottom wall, and a pair of opposite side walls with a generally U-shaped locking shoulder projecting outwardly beyond the bottom wall and designed to be in locking engagement with the locking finger of the non-conductive housing when the terminal is properly inserted into the terminal receiving passage, and a pair of outwardly extending rounded projections on the side walls for riding in the rounded grooves in the side walls of the passage, the projections being spaced said given distance from the top wall, and said locking shoulder being spaced from the projections a distance greater than said given distance whereby the front contact end of the terminal can be inserted into the passage only when the top wall of the terminal top wall of the passage are juxtaposed to align the projections on the terminal with the grooves in the passage, the conductive terminal with the smooth outside surface of the front contact end, the rounded projections, and the generally U-shaped locking shoulder insertable through the through hole in the elastomeric seal and into the passage in the housing.

10. The electrical connector of claim 9 wherein the front contact end of said terminal is generally square in cross-section.

* * * * *